US007699631B2

(12) United States Patent
Knepper

(10) Patent No.: US 7,699,631 B2
(45) Date of Patent: Apr. 20, 2010

(54) ELECTRICAL DISTRIBUTION HARNESS ASSEMBLY

(75) Inventor: Andrew Knepper, Kendallville, IN (US)

(73) Assignee: Group Dekko, Inc., Kendallville, IN (US)

( * ) Notice: Subject to any disclaimer, the term of this patent is extended or adjusted under 35 U.S.C. 154(b) by 0 days.

(21) Appl. No.: 11/837,815

(22) Filed: Aug. 13, 2007

(65) Prior Publication Data

US 2008/0045060 A1 Feb. 21, 2008

Related U.S. Application Data

(63) Continuation-in-part of application No. 29/282,316, filed on Jul. 17, 2007, now Pat. No. Des. 580,872, and a continuation-in-part of application No. 29/282,317, filed on Jul. 17, 2007, now Pat. No. Des. 581,366, and a continuation-in-part of application No. 29/282,318, filed on Jul. 17, 2007, now Pat. No. Des. 588,544.

(60) Provisional application No. 60/837,703, filed on Aug. 15, 2006.

(51) Int. Cl.
*H01R 4/60* (2006.01)

(52) U.S. Cl. ..... 439/215

(58) Field of Classification Search ..... 439/215, 439/532; 174/68.1, 49, 101, 371, 16.2; 52/220.5
See application file for complete search history.

(56) References Cited

U.S. PATENT DOCUMENTS

| | | | | |
|---|---|---|---|---|
| 2,090,239 | A * | 8/1937 | Strang | 138/116 |
| 3,804,970 | A * | 4/1974 | Oldman | 174/16.2 |
| 4,349,220 | A * | 9/1982 | Carroll et al. | 285/151.1 |
| 5,203,711 | A * | 4/1993 | Bogiel | 439/215 |
| 6,530,181 | B1 * | 3/2003 | Seiber et al. | 52/126.3 |
| 6,936,766 | B1 * | 8/2005 | Galasso | 174/481 |

* cited by examiner

*Primary Examiner*—Alexander Gilman
(74) *Attorney, Agent, or Firm*—Taylor & Aust, P.C.

(57) ABSTRACT

An electrical distribution harness assembly of a modular power assembly for providing power to an office furniture assembly including an exterior surface includes at least one electrical connector, a channel, and a cover. The channel includes a wireway and at least one slideway integral with the wireway. The channel is coupled with the at least one electrical connector and is configured for carrying a plurality of electrical conductors. The cover is slidably received within the at least one slideway.

16 Claims, 4 Drawing Sheets

ELECTRICAL DISTRIBUTION HARNESS ASSEMBLY

CROSS REFERENCE TO RELATED APPLICATIONS

This is a non-provisional application based upon U.S. provisional patent application Ser. No. 60/837,703, entitled "UNDER-TABLE POWER ASSEMBLY", filed Aug. 15, 2006, which is incorporated by reference herein. This is a continuation-in-part of U.S. patent application Ser. No. 29/282,316, entitled "ELECTRICAL CONNECTOR", filed Jul. 17, 2007 now U.S. Pat. No. D,580,872, which is incorporated by reference herein. This is a continuation-in-part of U.S. patent application Ser. No. 29/282,317, entitled "ELECTRICAL CONNECTOR", filed Jul. 17, 2007 now U.S. Pat. No. D,581,366, which is incorporated by reference herein. This is a continuation-in-part of U.S. patent application Ser. No. 29/282,318, entitled "ELECTRICAL TERMINAL", filed Jul. 17, 2007 now U.S. Pat. No. D,588,544, which is incorporated by reference herein.

BACKGROUND OF THE INVENTION

1. Field of the Invention

The present invention relates to modular power assemblies for office furniture, and, more particularly, to an electrical distribution harness assembly.

2. Description of the Related Art

Office furniture, such as tables or desks, often need electrical power, or data cabling, to be provided to work surfaces associated with these tables or desks. Electrical wires, for instance, are often routed from the nearest electrical service outlet in a wall either to a power strip placed on a floor near a desk or directly to an electrical load (such as a lamp) on or near the desk. This can often result in a multiplicity of exposed, entangled, insulated wires being deposited on the floor near the desk and/or hanging from the desk and extending towards the floor or service outlet. This entanglement of unsecured wires can result in disorder, unpleasing aesthetics, and, even worse, disruption to the user.

Furthermore, the electrical power to such office furniture can be provided using modular power assemblies, which can include one or more electrical distribution harness assemblies. Electrical distribution harness assemblies can transport wires between two electrical connectors using a conductor carrier. Each electrical connector can be riveted to the conductor carrier, which is not always desirable.

What is needed in the art is an electrical distribution harness assembly which can be attached under a work surface so as to present a low profile and which includes an electrical connector and a conductor carrier which couple together quickly and easily.

SUMMARY OF THE INVENTION

The present invention provides an electrical distribution harness assembly which can be attached under a work surface so as to present a low profile and which includes an electrical connector and a conductor carrier which couple together quickly and easily.

The invention in one form is directed to an electrical distribution harness assembly of a modular power assembly for providing power to an office furniture assembly including an exterior surface. The electrical distribution harness assembly includes at least one electrical connector, a channel, and a cover. The channel includes a wireway and at least one slideway integral with the wireway. The channel is coupled with the at least one electrical connector and is configured for carrying a plurality of electrical conductors. The cover is slidably received within the at least one slideway.

The invention in another form is directed to an office furniture assembly including an article of office furniture including an exterior surface and an electrical distribution harness assembly coupled with the exterior surface. The electrical distribution harness assembly includes at least one electrical connector, a channel, and a cover. The channel includes a wireway and at least one slideway integral with the wireway. The channel is coupled with the at least one electrical connector and is configured for carrying a plurality of electrical conductors. The cover is slidably received within the at least one slideway.

The invention in yet another form is directed to a method of assembling an electrical distribution harness assembly of a modular power assembly for providing power to an office furniture assembly including an exterior surface. The method includes the steps of providing, placing, and receiving. The providing step provides a cover and a channel including a wireway and at least one slideway integral with the wireway. The placing step includes placing a plurality of electrical conductors and a portion of at least one electrical connector within the wireway. The receiving step includes slidably receiving the cover within the at least one slideway.

An advantage of the present invention is that it provides for under-table power in that the electrical distribution harness assembly can be attached to an exterior, under-table surface of an article of office furniture.

Another advantage is that it provides a channel having a low profile.

Yet another advantage is that it the electrical connector and the conductor carrier (including the channel and cover) can be coupled together quickly and easily.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
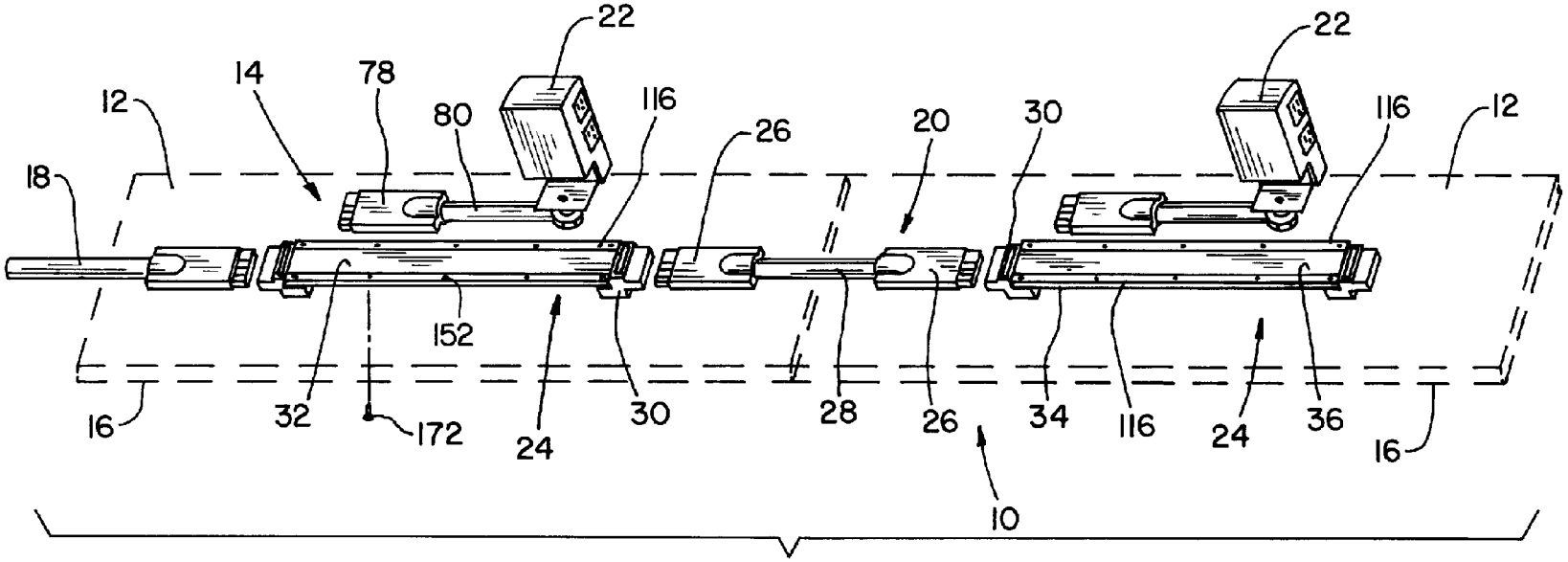
FIG. 1 is an exploded, perspective view of an office furniture assembly according to the present invention including a modular power assembly with an electrical distribution harness assembly.

Referring now to the drawings, and more particularly to FIG. 1, there is shown an office furniture assembly 10 which generally includes an article of office furniture 12 and a modular power assembly 14 configured for providing power to office furniture assembly 10. Article of office furniture 12 includes an exterior surface 16. Article of office furniture 12 can be a table 12, or a plurality of tables 12, and exterior surface 16 can be a bottom surface 16 of table 12. FIG. 1 shows two tables 12 adjacent one another. Modular power assembly 14 can include a power source (not shown), a power entry assembly 18, a jumper assembly 20, an electrical receptacle 22, and an electrical distribution harness assembly 24.

Jumper assembly 20 can include two male electrical connectors 26 and a flexible conduit 28 extending therebetween. Male electrical connectors 26 include a plurality of electrical terminals (not shown) and a plurality of locking features (not shown) which are configured for locking male electrical connector 26 to an electrical distribution block 30 of electrical distribution harness assembly 24. Conduit 28 carries a plurality of electrical conductors (not shown) also extending between each male electrical connector 26.

Receptacle 22 includes a plurality of outlets for providing electrical power to electrical loads (such as computers, lamps) associated with office furniture assembly 10. Receptacle 22 can be mounted on an edge of a table 12 as shown in FIG. 1.

Electrical distribution harness assembly 24 includes at least one electrical connector 30 and a conductor carrier 32. Conductor carrier 32 includes a channel 34 and a cover 36. Harness assembly 24 can include two electrical connectors 30. Harness assembly 24 is coupled with exterior surface 16 and can be configured for providing under-table power to office furniture assembly 10.

Figure 2:
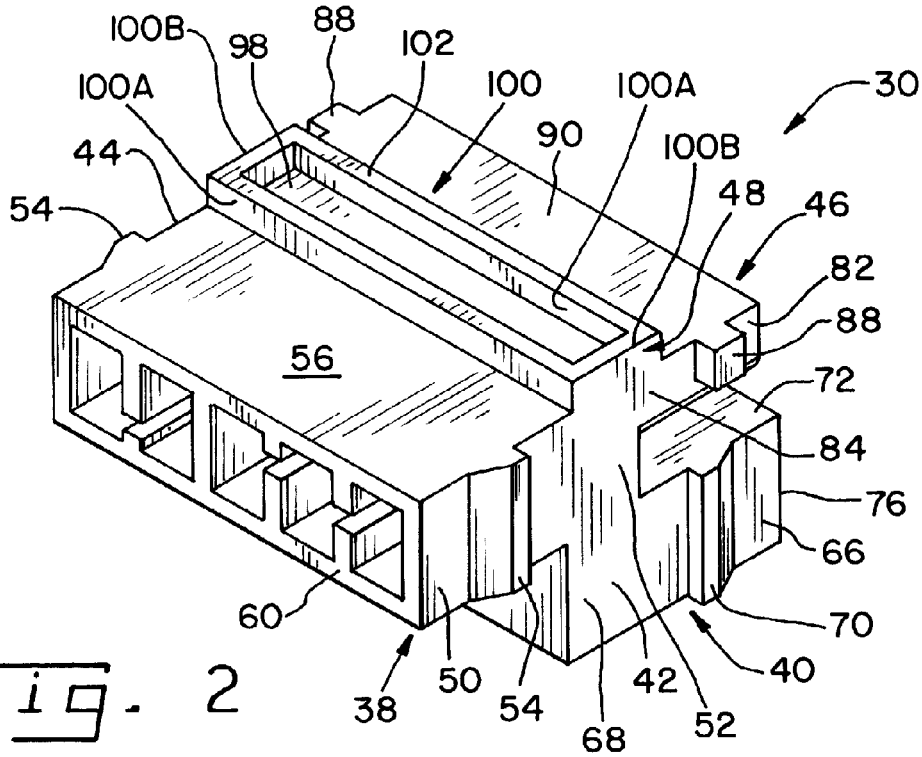
FIG. 2 is a perspective view of an electrical connector according to the present invention.
Figure 3:
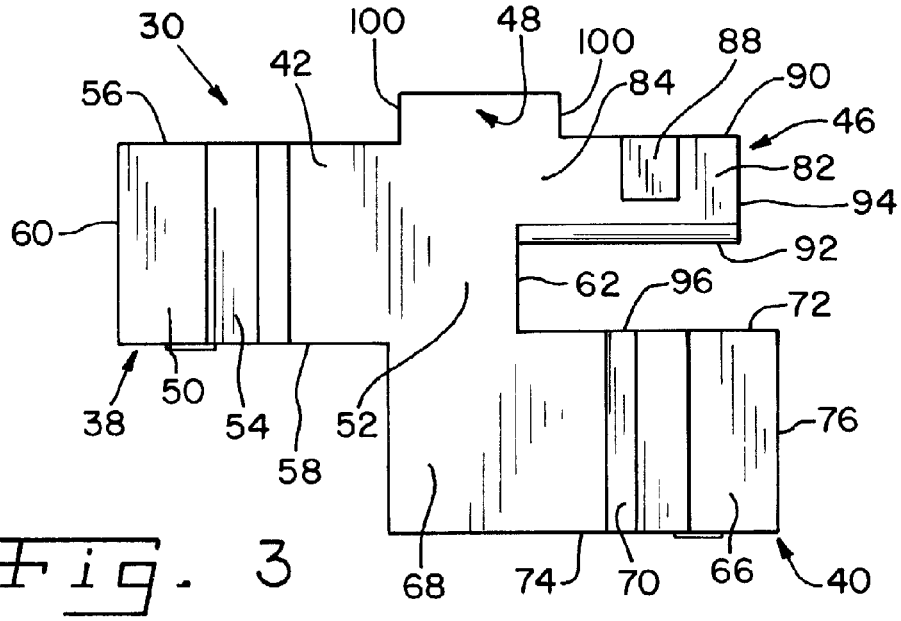
FIG. 3 is a side view of the electrical connector of FIG. 2

Electrical connector 30 (which can also be called an electrical distribution block or a female electrical connector) includes a first mating section 38, a second mating section 40, a first side 42, a second side 44 opposing first side 42, an ear section 46, a top section 48, and a plurality of electrical terminals (not shown), according to FIGS. 2-3. Electrical connector 30 can be made by overmolding to include electrical terminals within a body of electrical connector 30. First mating section 38 includes a front end 50, a rear end 52, a plurality of electrical terminals (not shown), a plurality of locking tabs 54, a top side 56, and a bottom side 58. First mating section 38 can include a generally rectangular shape when viewed from first or second side 42, 44, less top section 48. Front end 50 includes a front face 60 and matingly receives male electrical connector 26 of jumper assembly 20. Rear end 52 includes a rear side 62. One locking tab 54 is positioned on each of first and second sides 42, 44. Locking tabs 54 are configured for interlocking with locking features (not shown) of male electrical connector 26.

Second mating section 40 includes a front end 66, a rear end 68, a plurality of electrical terminals (not shown), a plurality of locking tabs 70, a top side 72, and a bottom side 74. Second mating section 40 can include a generally rectangular shape when viewed from first or second side 42, 44. Front end 66 includes a front face 76 and is configured for mechanically and electrically coupling with male electrical connector 26, a receptacle electrical connector 78 (coupled with receptacle 22 via a conduit 80), or directly to an electrical receptacle (not shown). One locking tab 70 is positioned on each of first and second sides 42, 44. Locking tabs 70 are configured for interlocking with locking features (not shown) of a receptacle or another electrical connector. Second mating section 40 can have approximately the same vertical thickness as that of first mating section 38, where vertical thickness constitutes the distance respectively between top side 56, 72 and bottom side 58, 74 of first mating section 38 or second mating section 40. Second mating section 40 is vertically and horizontally offset from, and runs generally parallel to, first mating section 38. Second mating section 40 can be described as being positioned below first mating section 38. More specifically, rear end 68 of second mating section 40 and rear end 52 of first mating section 38 stack directly upon each other and are formed integral relative to one another. Together, first and second mating sections 38, 40 generally form a Z-shape when viewed from first side 42 of electrical connector 30 (or generally an S-shape when viewed from opposing second side 44 of electrical connector 30); that is, running from front end 50 of first mating section 38 to front end 66 of second mating section 40, electrical connector 30 has a general Z-shape when viewed from first side 42.

Ear section 46 includes a front end 82, a rear end 84, a plurality of electrical terminals (not shown) configured for coupling with a plurality of electrical conductors 86, a plurality of mounting projections 88 (which can also be called mounting ears), a top side 90, and a bottom side 92. Ear section 46 can include a generally rectangular shape when viewed from first or second side 42, 44, less top section 48. Front end 82 includes a front face 94 and is configured for housing a portion of electrical terminals (not shown) where electrical conductors 86 are crimped, and thus held securely, by electrical terminals (not shown). Ears 88 can include a total of two ears 88; each ear 88 can be substantially similar (thus, a description of one ear 88 serves as a description of the other). One ear 88 extends respectively from each of first and second sides 42, 44. Ear 88 can have a general cube or block shape and, thus, have a general square or rectangular cross-section. Alternatively, ear 88 can have a different shape, such as a sphere. Similarly, the cross-section of each ear 88 can be circular, triangular, or some other shape. Ear 88 can be positioned flush with top side 90 of ear section 46 and extend only part of the way from top side 90 to bottom side 92 of ear section 46. Ear 88 can be positioned more towards front end 82 of ear section 46 than towards rear end 84 of ear section 46. Ears 88 can be overmolded along with, and of the same material as, the body of electrical connector 30 and, thus, can be formed integral with the body of electrical connector 30.

Ear section 46 is horizontally offset from and generally parallel to first mating section 38. Ear section 46 can be less in vertical thickness than first mating section 38. Top side 90 of ear section 46 can be vertically offset from top side 56 of first mating section 38 such that top side 90 of ear section 46 is higher than top side 56 of first mating section 38. Rear end 84 of ear section 46 can integrally couple with rear end 52 of first mating section 38. Ear section 46 is vertically offset from and generally parallel to second mating section 40. Ear section 46 can be less in vertical thickness than second mating section 40. Front face 94 of ear section 46 may not extend as far horizontally from front face 60 of first mating section 38 than does front face 76 of second mating section 40. Together, then, ear section 46, rear end 52 of first mating section 38, and second mating section 40 form a general U-shape, ear section 46 and second mating section 40 forming the legs of the U and rear end 52 of first mating section 38 forming the base of the U. Stated another way, bottom side 92 of ear section 46, rear side 62 of rear end 52 of first mating section 38, and top side 72 of second mating section 40 define a cutout 96 in electrical connector 30.

Top section 48 includes a base 98 and four upstanding walls 100. Top section 48 straddles first mating section 38 and ear section 46. Base 98 is a horizontal wall spanning between four upstanding walls 100 and is positioned at lower ends of upstanding walls 100. Upstanding walls 100 are coupled together so as to generally form a rectangle including two longitudinal walls 100A, two transverse walls 100B, and a top side 102. Top side 102 of walls 100 are generally flush relative to one another. In one embodiment of the present invention, however, top side 102 is not flush with base 98, as base 98 is lower in elevation than top side 102, as shown in FIG. 2. Alternatively, base 98 can be flush with top side 102 of upstanding walls 100 such that top section 48 forms a single block on top of electrical connector 30. Alternatively, top section 48 may raise from top side 56 of first mating section 38 and then be a generally level surface that is flush with top side 90 of ear section 46.

Longitudinal walls 100A of top section 48 are generally parallel relative to one another and run from first side 42 of electrical connector 30 to second side 44 of electrical connector 30. Longitudinal walls 100A can include a first longitudinal wall 100A and a second longitudinal wall 100A. First longitudinal wall 100A couples with, and is perpendicular to, top side 56 of first mating section 38. Second longitudinal wall 100A couples with, and is perpendicular to, top side 90 of ear section 46. While top sides 102 of longitudinal walls 100A are generally flush relative to one another, first longitudinal wall 100A can have a greater height than second longitudinal wall 100A, considering that top side 102 of first mating section 38 can be generally lower relative to top side 90 of ear section 46. Transverse walls 100B are also generally parallel relative to one another and are generally flush with first and second sides 42, 44 of electrical connector 30.

Figure 4:
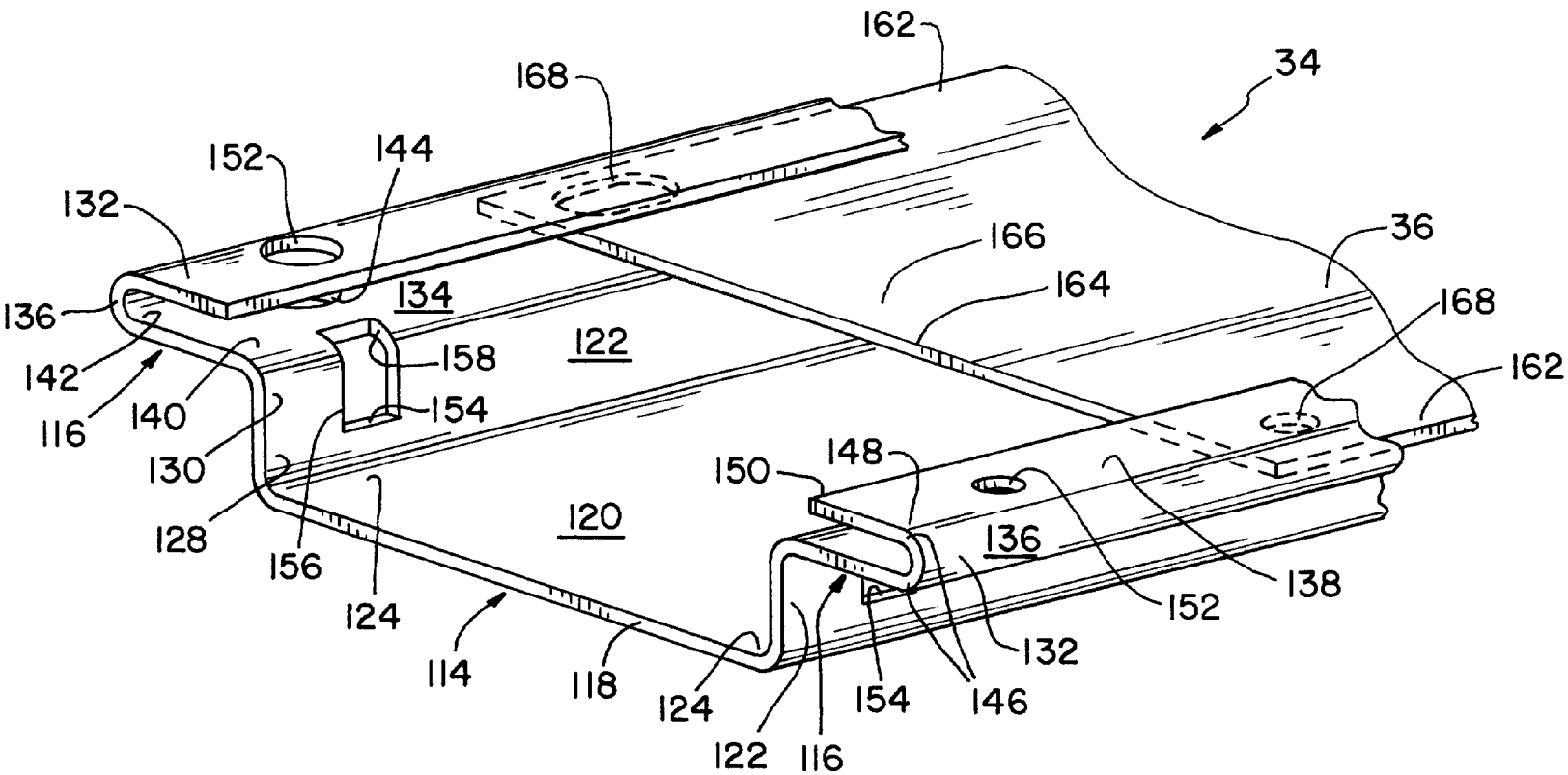
FIG. 4 is a fragmentary, perspective view of a channel, with a cover partially slid into the wireway, according to the present invention.
Figure 5:
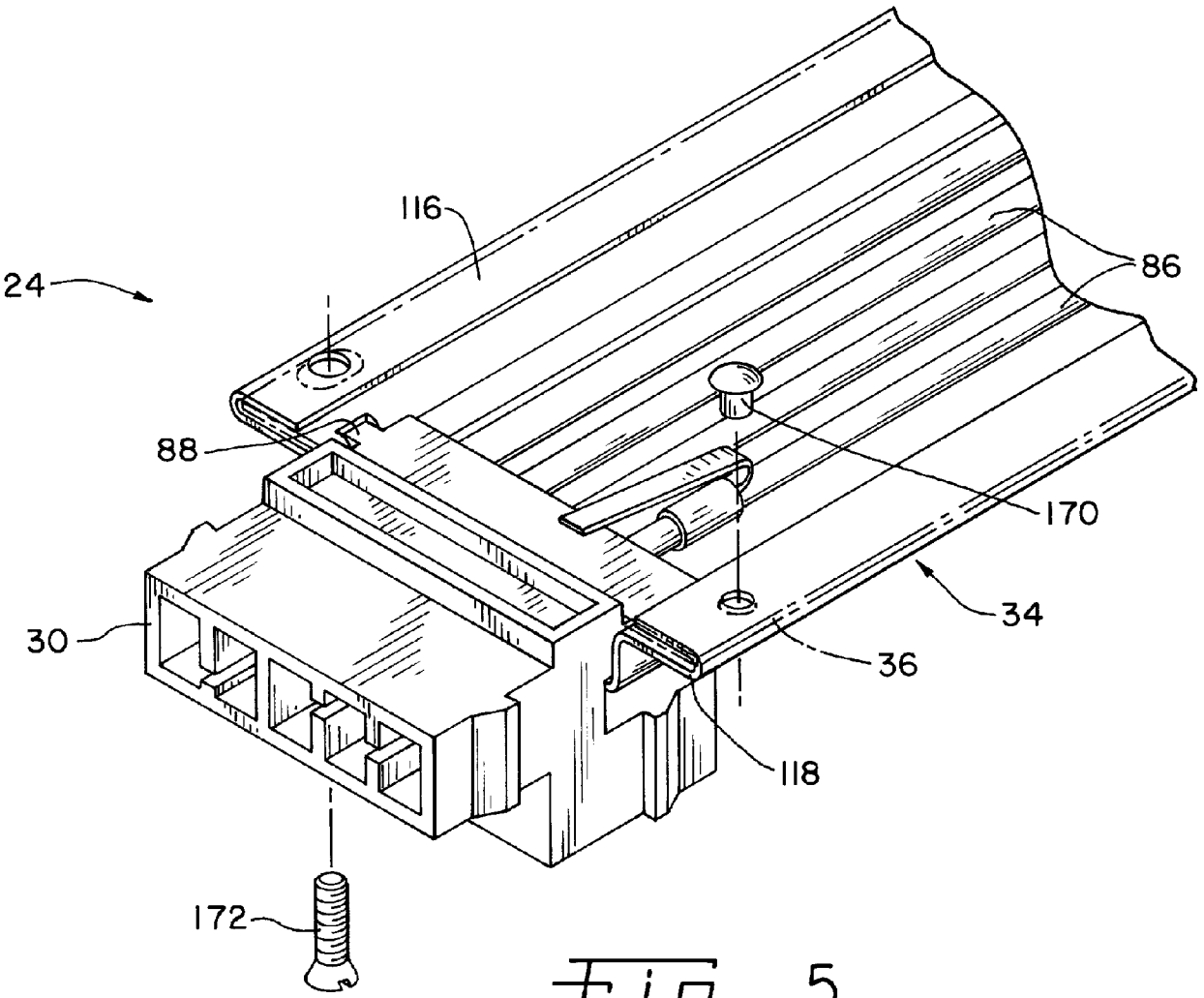
FIG. 5 is a fragmentary, partially exploded, perspective view of one end of the electrical distribution harness assembly according to the present invention, with the cover in phantom.

Channel 34 includes a wireway 114, at least one slideway 116 (such as two slideways 116) formed integral with wireway 114, and two opposing terminating ends 118 including portions of both wireway 114 and slideway 116, as shown in FIGS. 4-5. Channel 34 is configured for carrying a plurality of electrical conductors 86. Furthermore, channel 34 can have a low profile and can be configured for being mounted to exterior surface 16. Channel 34 can be formed from a metal (such as stainless steel) blank and stamped and shaped such that all parts of channel 34 are formed integral relative to one another. Alternatively, wireway 114 and slideway 116 can be formed separately and then joined together.

Wireway 114 includes a horizontal base 120 and two vertical walls 122. Base 120 has a generally rectangular shape. Base 120 includes two longitudinal sides 124 and a generally flat expanse extending between longitudinal sides 124. Base 120 extends longitudinally and terminates longitudinally at opposing ends 118. Each vertical wall 122 includes a bottom side 128 and a top side 130. Bottom side 128 of each vertical wall 122 is correspondingly connected to each longitudinal side 124. Each vertical wall 122 is generally perpendicular to base 120, runs the longitudinal length of base 120, and terminates longitudinally at opposing ends 118. Wireway 114 is configured for carrying electrical conductors 86.

Each slideway 116 is substantially similar, and a description of one slideway 116 serves as a description of the other slideway 116, unless stated otherwise. Slideway 116 includes an inwardly curled flange 132 having a general U-shape. Each inwardly curled flange 132 curls inwardly relative to wireway 114 (that is, generally back towards wireway 114). Flange 132 includes a bottom leg 134, a curved leg 136, and a top leg 138 coupled with bottom leg 134 via curved leg 136.

Bottom leg 134 includes a proximal end 140 and a distal end 142 and defines a plurality of through-holes 144. Proximal end 140 of bottom leg 134 is formed integral with top side 130 of vertical wall 122. Bottom leg 134 can extend generally perpendicular to vertical wall 122 and generally parallel to base 120 of wireway 114. Running from proximal end 140 to distal end 142, bottom leg 134 projects away from vertical wall 122 and away from a base plane which is perpendicular to base 120 and which runs longitudinally between ends 118 and along a midline centered between each vertical wall 122. That is, bottom leg 134 is vertically and horizontally offset from base 120. Bottom leg 134 runs the longitudinal length of vertical wall 122 and terminates at opposing ends 118.

Holes 144 of bottom leg 134 can be regularly spaced relative to one another along the longitudinal length of bottom leg 134 and can be generally circular in shape. Holes 144 can be substantially the same size relative to one another. Alternatively, one hole 144 can be smaller than the remaining holes 144 of bottom leg 134, the remaining holes 144 being substantially the same size relative to one another. The smaller hole 144 can be positioned at terminating end 118 of channel 34. The other bottom leg 134 (of the other slideway 116) similarly can include one smaller hole 144 and larger remaining holes 144. The smaller hole 144 of the other bottom leg 134, however, is located at the other terminating end 118 of channel 34. The smaller holes 144 of the bottom legs 134 are, thus, located diagonally (at opposing terminating ends 118) relative to one another. Bottom leg 134 can include five through-holes 144 (ten through-holes 144 in total for both bottom legs 134 of channel 34).

Curved leg 136 includes two opposing ends 146. One end 146 is connected to, and formed integral with, distal end 142 of bottom leg 134. The other end 146 is connected to, and formed integral with, top leg 138 (specifically, proximal end 148 of top leg 138). Curved leg 136 has a short radius of curvature. While not directly connected to vertical wall 122, curved leg 136 runs the longitudinal length of vertical wall 122 and terminates at opposing ends 118.

Top leg 138 includes a proximal end 148 and a distal end 150 (which serves as not only the free terminating end of top leg 138 but also as the free terminating end of inwardly curled flange 132) and defines a plurality of through-holes 152. Proximal end 148 of top leg 138 is connected to, and formed integral with, curved leg 136. Running from proximal end 148 to distal end 150, top leg 138 projects away from curved leg 136 and towards the base plane described above. Top leg 138 is generally parallel to bottom leg 134 and base 120 and is generally perpendicular to a vertical wall plane running through vertical wall 122. Stated another way, top leg 138 is vertically and horizontally offset from base 120. Top leg 138 can be shorter than bottom leg 134 such that distal end 150 of top leg 138 terminates short of reaching the vertical wall plane. While not directly connected to vertical wall 122, top leg 138 runs the longitudinal length of vertical wall 122 and terminates at opposing ends 118.

Holes 152 of top leg 138 can be regularly spaced relative to one another along the longitudinal length of top leg 138 and can be generally circular in shape. Holes 152 can be substantially the same size relative to one another. Alternatively (as described above relative to bottom leg 134), one hole 152 can be smaller than the remaining holes 152 of top leg 138, the remaining holes 152 being substantially the same size relative to one another. The smaller hole 152 can be positioned at terminating end 118 of channel 34. The other top leg 138 (of the other slideway 116) similarly can include one smaller hole 152 and larger remaining holes 152. The smaller hole 152 of the other top leg 138, however, is located at the other terminating end 118 of channel 34. The smaller holes 152 of top legs 138 are, thus, located diagonally (at opposing terminating ends 118) relative to one another. As with bottom leg 134, top leg 138 can include five through-holes 152 (ten through-holes 152 in total for both top legs 138 of channel 34). Holes 152 of top leg 138 are vertically aligned with corresponding holes 144 of bottom leg 134 (as shown in FIG. 4). The larger and smaller holes 144, 152 of top and bottom legs 138, 134 are, thus, respectively aligned with each other. The larger holes 152 of top leg 138 can be relatively the same size and shape as the larger holes 144 of bottom leg 134, and the smaller holes 152 of top leg 138 can be relatively the same size and shape as the smaller holes 144 of bottom leg 134.

Two opposing terminating ends 118 of channel 34 (which can also be called the longitudinal ends of channel 34) include the longitudinally terminating ends of both wireway 114 and slideway 116. Each longitudinal end 118 of channel 34 is substantially similar, and a description of one longitudinal end 118 serves as a description of the other longitudinal end 118, unless stated otherwise. Longitudinal end 118 includes two mounting through-holes 154, which can be substantially similar (a description of one through-hole, thus, serves as a description of the other). Through-hole 154 can span a portion of vertical wall 122 of wireway 114 and a portion of bottom leg 134 of slideway 116. More specifically, through-hole 154 can be generally rectangular in shape and have a longitudinal direction running from a position located near bottom side 128 of vertical wall 122 of wireway 114 to a position located in proximal end 140 of bottom leg 134 of slideway 116. Thus, through-hole 154 can follow a curve where vertical wall 122 couples with bottom leg 134. In so doing, each through-hole 154 includes a horizontally facing portion 156 and an upwardly facing potion 158. Horizontally facing portion 156 can be larger than upwardly facing portion 158. Depending upon the shape and size of mounting ear 88, through-hole 154 can have a different shape and size.

Cover 36 includes a generally flat expanse with a generally rectangular shape. Cover further includes two opposing longitudinal sides 162, two opposing transverse sides 164, and two opposing ends 166 including transverse sides 164 and portions of longitudinal sides 162. Each longitudinal side 162 is substantially similar, and a description of one longitudinal side 162 serves as a description of the other, unless stated otherwise. Similarly, each transverse side 164 is substantially similar, and a description of one transverse side 164 serves as a description of the other, unless stated otherwise.

Longitudinal side 162 includes a plurality of through-holes 168. Holes 168 of longitudinal side 162 can be regularly spaced relative to one another along the longitudinal length of longitudinal side 162. Holes 168 of longitudinal side 162 can be generally circular in shape and substantially the same size relative to one another. Alternatively (as described above relative to bottom and top legs 134, 138), one hole 168 can be smaller than the remaining holes 168 of longitudinal side 162, the remaining holes 168 being substantially the same size and shape relative to one another. The smaller hole 168 can be positioned at terminating end 166 of cover 36. While the smaller holes 168 can be circular in shape, the larger holes 168 can be elliptical or oblong in shape, as shown in FIGS. 4-5. The other longitudinal side 162 similarly can include one smaller hole 168 and larger remaining holes 168, the smaller hole 168 being circular and the larger holes 168 being elliptical or oblong in shape. The smaller hole 168 of the other longitudinal side 162, however, is located at the other terminating end 166 of cover 36. The smaller holes 168 of the longitudinal sides 162 are, thus, located diagonally (at opposing terminating ends 166) relative to one another. As with bottom and top legs 134, 138, longitudinal side 162 can include five through-holes 168 (ten through-holes 168 in total for both longitudinal sides 162 of cover 36). When cover 36 is positioned within slideways 116, holes 168 of longitudinal sides 162 are vertically aligned with corresponding holes 144, 152 of bottom and top legs 134, 138. The smaller holes 168, 144, 152 of longitudinal side 162 and bottom and top legs 134, 138 are respectively aligned with each other, and the larger holes 168, 144, 152 of longitudinal side 162 and bottom and top legs 134, 138 are also respectively aligned with each other, as indicated in FIGS. 4-5. The smaller holes 168 of cover 36 can be relatively the same size and shape as the smaller holes 144, 152 of bottom and top legs 134, 138. Longitudinal sides 162 are generally perpendicular to transverse sides 164, which are positioned at ends 166. Longitudinal sides 162 of cover 36 are slidably received respectively within slideways 116, as shown in FIGS. 4-5.

Cover 36 is, thus, attachable and completely detachable from slideways 116 in normal use. Cover 36 has substantially the same length as channel 34 and a width that is slightly less than the width between each curved leg 136 of opposing slideways 116 of channel 34. Cover 36 has a thickness that is also slightly less than the distance between interior surfaces of top and bottom legs 134, 138 of each slideway 116, the interior surfaces of slideway 116 being those surfaces on the inside of the U-shape of slideway 116 (the inside of the U facing generally back towards wireway 114). Cover 36 is shown, in FIG. 4, as being partially slid into wireway 114. In FIG. 5, cover 36 is shown, in phantom, fully inserted in wireway 114.

In use, electrical conductors 86 are coupled with terminals of ear section 46 of electrical connector 30. One electrical connector 30 is coupled with one end 118 of channel 34. That is, electrical conductors 86 and a portion of electrical connector 30 are placed within wireway 114 of channel 34. In so doing, end 118 of channel 34—specifically, an end 118 of base 120 of wireway 114—is inserted in cutout 96 of electrical connector 30 until ears 88 are aligned with ear mounting holes 154. Ears 88 are then dropped down into, or otherwise inserted, seated, or positioned, in corresponding ear holes 154. Upon ears 88 being seated in ear holes 154, end 118 of base 120 may contact, or be very close to, rear end 52 of first mating section 38 of electrical connector 30. A second electrical connector 30 can also be coupled, in a similar manner, with electrical conductors 86 and with the other end 118 of channel 34.

Cover 36 can then be slidably received within each of slideways 116, starting on one end 118 of channel 34 and sliding cover 36 through slideways 116 until cover 36 generally reaches the other end 118 of channel 34 such that ends 166 of cover 36 generally align with ends 118 of channel 34. While cover 36 can be substantially the same length as channel 34, cover 36 can be a little shorter or longer than channel 34. Longitudinal sides 162 of cover 36 enter, and are slid through, the respective gaps formed by legs 134, 136, 138 of each slideway 116. Opposing ends 166 of cover 36, then, at least partly overlap ear sections 46 of each electrical connector 30. In at least partly overlapping each electrical connector 30 (which is positioned on each end 118 of channel 34), cover 36, together with ears 88 in ear holes 154, couples each electrical connector 30 with channel 34. In so coupling electrical connectors 30 with channel 34, each end 166 of cover 36 can abut, or nearly contact, second longitudinal upstanding wall 100A of top section 48 of electrical connector 30. Furthermore, cover 36 covers electrical conductors 86 within wireway 114.

Holes 168 of cover 36 are vertically aligned with corresponding holes 144, 152 of slideways 116. Thus, cover 36 can be secured to at least one slideway 116 (such as both slideways 116) using rivets 170 (shown in FIG. 5) or some other type of fastener through holes 144, 152, 168 of slideways 116 and cover 36. Additionally, electrical distribution harness assembly 24 can be coupled to bottom surface 16 of table 12 by inserting a screw 172 (shown in FIGS. 1 and 5) through one or more sets of aligned holes 144, 152, 168 and screwing screws 172 into bottom surface 16. More specifically, given ten sets of aligned holes 144, 152, 168 relative to bottom legs 134, top legs 138, and longitudinal sides 162, two rivets 170 can be used in two sets of holes 144, 152, 168 and eight screws 172 can be used in the remaining eight sets of holes 144, 152, 168. One rivet 170 is used respectively in each of the smaller sets of holes 144, 152, 168. One screw 172 is used respectively in each of the remaining larger sets of holes 144, 152, 168. Rivets 170 can be used to couple cover 36 and slideways 116 together. Screws 172 can be used to couple electrical distribution harness assembly 24 to bottom surface 16 of table 12.

One electrical distribution harness assembly 24 can, thus, be mounted to bottom surface 16 of table 12. Another electrical distribution harness assembly 24 can be mounted to bottom surface 16 of another table 12 as well, as shown in FIG. 1. Power entry assembly 18 can be used to provide power to one electrical connector 30 of electrical distribution harness assembly 24. Jumper assembly 20 can then span the gap between, and thus couple together, the two electrical distribution harness assemblies 24 shown in FIG. 1. Male electrical connectors 26 of jumper assembly 20 mate respectively with electrical connectors 30 of electrical distribution harness assemblies 24. Receptacle 22 can include a conduit 80 terminating in an electrical connector 78. Receptacle electrical connector 78 can couple with second mating section 40 of electrical connector 30 (as indicated by juxtaposition in FIG. 1) or with an unused first mating section 38 of connector 30. While FIG. 1 does not show any of electrical connectors 18, 26, 30, 78 actually connected to any other electrical connector, the juxtaposition of an electrical connector next to another electrical connector in FIG. 1 serves to indicate a connection between those electrical connectors. Modular power assembly 14, including jumper assemblies 20, electrical distribution harness assemblies 24, and receptacles 22, can be empowered by electrical connection to a power source (not shown) using power entry assembly 18, as shown in FIG. 1. Channel 34 has a low profile so that channel 34 provides clearance for a user of table 12 when electrical distribution harness assembly 24 is mounted under table 12.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution harness assembly of a modular power assembly for providing power to an office furniture assembly including an article of office furniture including an exterior surface, said electrical distribution harness assembly comprising:

at least one electrical connector including a plurality of projections and an end configured for connecting to a plurality of electrical conductors;

a channel including a wireway and at least one slideway integral with said wireway, said channel coupled with said at least one electrical connector and configured for carrying said plurality of electrical conductors; and a cover slidably received within said at least one slideway, said cover at least partly overlapping said end of said at least one electrical connector and thereby in part coupling said at least one electrical connector with said channel and preventing said at least one electrical conductor from disconnecting from said channel, said cover including a flat expanse, said channel including at least one end defining a first plurality of holes each of which is open toward said flat expanse of said cover, each of said plurality of projections positioned in a corresponding one of said first plurality of holes.

2. The electrical distribution harness assembly of claim 1, wherein said cover, together with said plurality of projections, couples said at least one electrical connector with said channel.

3. The electrical distribution harness assembly of claim 1, wherein said at least one slideway includes an inwardly curled flange.

4. The electrical distribution harness assembly of claim 3, wherein said inwardly curled flange defines at least one second hole and at least one third hole and said cover includes a first longitudinal side defining at least one fourth hole, said at least one second, third, and fourth holes being respectively aligned.

5. The electrical distribution harness assembly of claim 1, wherein said channel has a low profile and is configured for being mounted to an underside of one of a table and a desk.

6. An office furniture assembly comprising:

an article of office furniture including an exterior surface; and an electrical distribution harness assembly coupled with said exterior surface, said electrical distribution harness assembly including:

at least one electrical connector including a plurality of projections and an end configured for connecting to a plurality of electrical conductors;

a channel including a wireway and at least one slideway integral with said wireway, said channel coupled with said at least one electrical connector and configured for carrying said plurality of electrical conductors; and a cover slidably received within said at least one slideway, said cover at least partly overlapping said end of said at least one electrical connector and thereby in part coupling said at least one electrical connector with said channel and preventing said at least one electrical conductor from disconnecting from said channel, said cover including a flat expanse, said channel including at least one end defining a first plurality of holes each of which is open toward said flat expanse of said cover, each of said plurality of projections positioned in a corresponding one of said first plurality of holes.

7. The office furniture assembly claim 6, wherein said cover, together with said plurality of projections, couples said at least one electrical connector with said channel.

8. The office furniture assembly of claim 6, wherein said at least one slideway includes an inwardly curled flange.

9. The office furniture assembly of claim 8, wherein said inwardly curled flange defines at least one second hole and at least one third hole and said cover includes a first longitudinal side defining at least one fourth hole, said at least one second, third, and fourth holes being respectively aligned.

10. The office furniture assembly of claim 6, wherein said channel has a low profile, said article of office furniture being one of a table and a desk, said exterior surface being an underside of said article of office furniture, said electrical distribution harness assembly configured for being mounted to said underside.

11. A method of assembling an electrical distribution harness assembly of a modular power assembly for providing power to an office furniture assembly including an exterior surface, said method comprising the steps of:

providing a cover and a channel including a wireway and at least one slideway integral with said wireway;

placing a plurality of electrical conductors and a portion of at least one electrical connector within said wireway;

connecting an end of said at least one electrical connector to said plurality of electrical conductors;

slidably receiving said cover within said at least one slideway, said cover at least partly overlapping said end of said at least one electrical connector and thereby in part coupling said at least one electrical connector with said channel and preventing said at least one electrical conductor from disconnecting from said channel; and inserting a plurality of projections of said at least one electrical connector in a corresponding first plurality of holes defined by an end of said channel, said cover including a flat expanse, each of said first plurality of holes being open toward said flat expanse of said cover.

12. The method of assembling of claim 11, wherein said at least one slideway includes an inwardly curled flange.

13. The method of assembling of claim 11, wherein said cover, together with said plurality of projections, couples said at least one electrical connector with said channel.

14. The method of assembling of claim 11, further comprising the step of aligning at least one second hole, at least one third hole, and at least one fourth hole, said at least one second and third holes defined by said at least one slideway, said at least one fourth hole defined by a longitudinal side of said cover.

15. The method of assembling of claim 14, further comprising the step of securing said cover to said at least one slideway using said second, third, and fourth plurality of holes.

16. The method of assembling of claim 11, wherein said channel has a low profile, the office furniture assembly including an article of office furniture which is one of a table and a desk, the exterior surface being an underside of said article of office furniture, the electrical distribution harness assembly being mounted to said underside.

* * * * *